US007381320B2

(12) United States Patent
Iqbal et al.

(10) Patent No.: US 7,381,320 B2
(45) Date of Patent: Jun. 3, 2008

(54) HEAVY OIL AND BITUMEN UPGRADING

(75) Inventors: Rashid Iqbal, Houston, TX (US); Anshumali, Mobile, AL (US); Odette Eng, Sugar Land, TX (US); Phillip Niccum, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 578 days.

(21) Appl. No.: 10/711,176

(22) Filed: Aug. 30, 2004

(65) Prior Publication Data

US 2006/0042999 A1 Mar. 2, 2006

(51) Int. Cl.

| | |
|---|---|
| ***C10G 1/04*** | (2006.01) |
| ***C10G 11/00*** | (2006.01) |
| ***C10G 45/00*** | (2006.01) |
| ***C10C 1/18*** | (2006.01) |
| ***C10C 3/08*** | (2006.01) |
| ***B01J 8/18*** | (2006.01) |

(52) U.S. Cl. ..... 208/86; 208/45; 208/113; 208/309; 208/390; 208/251 R; 422/140

(58) Field of Classification Search ..... 208/39, 208/40, 41, 42, 43, 44, 45, 86, 106, 107, 208/108, 113, 133, 134, 309, 390, 251 R, 208/251 H; 422/139, 140

See application file for complete search history.

(56) References Cited

U.S. PATENT DOCUMENTS

| | | | | |
|---|---|---|---|---|
| 2,940,920 A | | 6/1960 | Garwin | 208/45 |
| 3,647,682 A | | 3/1972 | Rato et al. | 208/120.15 |
| 3,758,403 A | | 9/1973 | Rosinshi et al. | 502/67 |
| 3,785,782 A | | 1/1974 | Cartmell | 422/144 |
| 3,925,189 A | | 12/1975 | Wicks, III | 208/390 |
| 4,160,718 A | | 7/1979 | Rendall | 208/390 |
| 4,347,118 A | | 8/1982 | Funk et al. | 208/390 |
| 4,404,095 A | | 9/1983 | Haddad et al. | 208/161 |
| 4,419,221 A | | 12/1983 | Castagnos, Jr. | 208/113 |
| 4,424,112 A | | 1/1984 | Rendall | 208/390 |
| 4,814,067 A | | 3/1989 | Gartside et al. | 208/127 |
| 4,828,679 A | | 5/1989 | Cormier, Jr. et al. | 208/120.05 |
| 4,875,998 A | | 10/1989 | Rendall | 208/390 |
| RE33,728 E | | 10/1991 | Dean et al. | 208/120.15 |
| 5,192,421 A | * | 3/1993 | Audeh et al. | 208/309 |
| 5,843,303 A | | 12/1998 | Ganeshan | 208/309 |
| 6,357,526 B1 | | 3/2002 | Abdel-Halim et al. | 166/272.3 |

FOREIGN PATENT DOCUMENTS

JP 2002-302680 * 10/2002

OTHER PUBLICATIONS

J. Reese et al., Industrial Applications of Three-Phase Fluidization Systems, in Fluidization, Solids Handling, and Processing, Noyes Publications (Westwood, New Jersey 1998).*

P.S. Wallace et al., Heavy Oil Upgrading by the Separation and Gasification of Asphaltenes, Gasification Technologies Conference (San Francisco 1998), available at http://www.gasification.org/Docs/1998_Papers/gtc9817p.pdf.*

* cited by examiner

*Primary Examiner*—Glenn Caldarola
*Assistant Examiner*—Randy Boyer
(74) *Attorney, Agent, or Firm*—KBR IP Legal Dept.

(57) ABSTRACT

Disclosed is a process for the upgrading and demetallizing of heavy oils and bitumens. A crude heavy oil and/or bitumen feed is supplied to a solvent extraction process 104 wherein DAO and asphaltenes are separated. The DAO is supplied to an FCC unit 106 having a low conversion activity catalyst for the removal of metals contained therein. The demetallized distillate fraction is supplied to a hydrotreater 110 for upgrading and collected as a synthetic crude product stream. The asphaltene fraction can be supplied to a gasifier 108 for the recovery of power, steam and hydrogen, which can be supplied to the hydrotreater 110 or otherwise within the process or exported. An optional coker 234 can be used to convert excess asphaltenes and/or decant oil to naphtha, distillate and gas oil, which can be supplied to the hydrotreater 220.

12 Claims, 4 Drawing Sheets

HEAVY OIL AND BITUMEN UPGRADING

BACKGROUND OF THE INVENTION

The present invention generally relates to the upgrading of heavy oils and bitumens. More particularly, the present invention relates to a process for the upgrading of heavy oils and bitumens including one or more of the steps of production, fractionation, solvent extraction, fluid catalytic cracking and hydrotreating to produce synthetic crude and/or naphtha, distillate and gas oil streams having reduced metal and/or sulfur content.

As world reserves of light, sweet crudes diminish and worldwide consumption of oil increases, refiners seek methods for extracting useful oils from heavier crude resources. The heavier crudes, which can include bitumens, heavy oils and tar sands, pose processing problems due to significantly higher concentration of metals, most notably nickel and vanadium. In addition, the heavier crudes typically have higher sulfur and asphaltene content, posing additional problems in the upgrading of crudes. Finally, tar sands, bitumens and heavy oils are extremely viscous, resulting in problems in transporting the raw materials by traditional means. Heavy oils and bitumens often must be maintained at elevated temperatures to remain flowable, and/or mixed with a lighter hydrocarbon diluent for pipeline transportation. The diluent can be expensive and additional cost can be incurred in transporting it to the location where production is occurring.

As the prices of light oil and natural gas continue to increase, the price of heavy oils and bitumens remains relatively low due to the difficulty in the recovery and upgrading to useable oils. The recovery of bitumens and other heavy crudes is expensive due to substantial energy requirements in the production.

Extensive reserves in the form of "heavy crudes" exist in a number of countries, including Western Canada, Venezuela, Russia, the United States, and elsewhere. These deposits of heavy crudes often exist in areas that are inaccessible by normal means. Generally, the term "heavy crude" refers to a hydrocarbon material having an API gravity of less than 20. Typical heavy crude oils are not fluid at ambient temperatures, and contain a high fraction of materials boiling above 343° C. (650° F.) and a significant portion with a boiling point greater than 566° C. (1050° F.). The high proportion of high boiling point hydrocarbons materials typical in heavy oils make fractionation difficult without resorting to vacuum fractionation.

High metals content in the hydrocarbon feed presents similar processing difficulties. Metals and asphaltenes in the heavy hydrocarbon materials are undesirable in the separated oil fractions as the metals tend to poison catalysts conventionally used in upgrading the oil fractions to other useful products. Asphaltenes will tend to foul/plug downstream equipment. Because of such difficulties during processing by conventional methods, the highest boiling portions are often thermally upgraded by coking or visbreaking processes. The heaviest fractions of heavy oil and bitumen containing the bulk of the metal and asphaltene can be separated by fractionation to recover lighter oils, which can be upgraded catalytically. However, the heavier fraction is still left with some usable oils that can not be extracted using fractionation techniques.

Metals present in heavy oils can include, for example, vanadium and nickel. Vanadium is typically present in excess of 100 wt ppm, often greater than 200 wt ppm. Nickel is typically present in excess of 50 wt ppm, with 75 wt ppm and greater also common.

Solvent extraction of the residuum oil has been known since the 1930's, as previously described in U.S. Pat. No. 2,940,920, to Garwin. With the introduction of the commercially available ROSE(r) process technology, solvent deasphalting processes have become more efficient and cost effective. Solvent deasphalting technology is commonly used today as one method of bottom-of-the-barrel upgrading in a deep conversion refinery and can also be used to produce fluid catalytic cracker (FCC) feeds, lube bright stocks, deasphalted gas oil feeds for hydrotreating and hydrocracking units, specialty resins, and heavy fuel and asphalt blending components from heavy oil feedstocks. Improved techniques in solvent extraction have been disclosed in U.S. Pat. No. 5,843,303 to Ganeshan.

Prior studies have focused on methods of increasing the transportability of heavy crudes by decreasing their viscosities. U.S. Pat. No. 5,192,421 to Audeh et al., discloses an improved method of demetallization during the deasphalting process, including the steps of deasphalting heavy asphalt-rich crudes, followed by thermal treatment, to produce deasphalted crude having a reduced metal content.

In U.S. Pat. No. 4,875,998, Rendall discloses the extraction of bitumen oils from tar-sands with hot water. Specifically, bitumen oils are conditioned in hot water and then extracted with a water immiscible hydrocarbon solvent to form a mixture which settles into several phases. Each phase can be processed to produce product bitumen oils and recycled process components. Other water or solvent extraction processes are disclosed in U.S. Pat. No. 4,160,718 to Rendall; U.S. Pat. No. 4,347,118 to Funk, et al.; U.S. Pat. No. 3,925,189 to Wicks, III; and U.S. Pat. No. 4,424,112 to Rendall. All patents and publications referenced to herein are hereby incorporated by reference in their entireties.

SUMMARY OF THE INVENTION

The present invention provides a method for the conversion of heavy crude feed, such as for example, bitumens, to useable lighter compounds having essentially no asphaltene and very low metal content.

In one embodiment, a process for upgrading crude oil from a subterranean reservoir of heavy oil or bitumen is provided. The process can include solvent deasphalting at least a portion of the heavy oil or bitumen to form an asphaltene fraction and a deasphalted oil (DAO) fraction essentially free of asphaltenes having a reduced metals content. A feed comprising the DAO fraction can be fed to a reaction zone of a fluid catalytic cracking (FCC) unit with FCC catalyst to deposit a portion of the metals from the DAO fraction onto the FCC catalyst. A hydrocarbon effluent having a reduced metal content can be recovered from the FCC unit.

The process can also include converting asphaltenes to steam, power, fuel gas, or a combination thereof for use in producing heavy oil or bitumen from a reservoir. The process can also include supplying the asphaltene fraction from the solvent deasphalting to the asphaltenes conversion. The process can also include removing metallized FCC catalyst from the FCC unit.

In one embodiment, a process for upgrading crude oil from a subterranean reservoir of heavy oil or bitumen is provided. The process can include converting asphaltenes to steam, power, fuel gas, or a combination thereof for use in producing heavy oil or bitumen from a reservoir. Means can be provided for solvent deasphalting at least a fraction of the produced heavy oil or bitumen containing high metals to form an asphaltene fraction and a deasphalted oil (DAO) fraction essentially free of asphaltenes and having a reduced metals content. The asphaltene fraction from the solvent deasphalting can be supplied to the asphaltenes conversion. A feed comprising the DAO fraction can be fed to a reaction zone of a fluid catalytic cracking (FCC) unit with FCC catalyst to deposit metals from the deasphalted oil fraction onto FCC catalyst. A demetallized hydrocarbon effluent can be recovered from the FCC unit; and metallized FCC catalyst can be removed from the FCC unit.

The heavy oil or bitumen production can include extraction from mined tar sands. The asphaltenes conversion can include gasification of a portion of the asphaltenes fraction to provide power, steam, fuel gas or combinations thereof for mining and extraction. The heavy oil or bitumen production can include injecting a mobilizing fluid through one or more injection wells completed in communication with the reservoir to mobilize the heavy oil or bitumen and producing the mobilized heavy oil or bitumen from at least one production well in communication with the reservoir. The mobilizing fluid can comprise steam generated primarily by combustion of asphaltenes recovered in the asphaltenes fraction from the solvent deasphalting.

The solvent deasphalting can have a high lift for maximizing the production of deasphalted oils. The process can include feeding a portion of the asphaltenes fraction to a delayed coker unit to produce coker liquids and coke. Lower boiling hydrocarbon fractions can be introduced to the FCC unit with the DAO fraction. The FCC unit can be operated at a conversion from 30 to 65 percent by volume of the feed to the FCC unit. The operating conditions in the FCC unit can be adjusted to control proportions of naphtha, distillate and gas oil in the hydrocarbon effluent from the FCC unit. The process can include hydrotreating the hydrocarbon effluent from the FCC unit to produce a low sulfur hydrocarbon effluent. The hydrotreating can be done at a moderate pressure of from 3.5 to 10.5 MPa (500 to 1500 psi). The process can further include gasifying asphaltenes recovered in the asphaltenes fraction from the solvent deasphalting to produce hydrogen for the hydrotreating.

In another embodiment, a process for upgrading crude oil from a subterranean reservoir of heavy oil or bitumen is provided. The process can include converting asphaltenes to steam, power, fuel gas, or a combination thereof for use in producing heavy oil or bitumen from a reservoir. The process also can include solvent deasphalting at least a fraction of the produced heavy oil or bitumen containing high metals to form an asphaltene fraction and a deasphalted oil (DAO) fraction essentially free of asphaltenes having a reduced metals content. The asphaltene fraction can be supplied from the solvent deasphalting to the asphaltenes conversion. Steam can be generated by combustion of asphaltenes recovered in the asphaltenes fraction from the solvent deasphalting. A feed comprising the DAO fraction, along with other lower boiling hydrocarbon fractions, can be supplied to a reaction zone of a fluid catalytic cracking (FCC) unit with FCC catalyst to recover a demetallized hydrocarbon effluent from the FCC unit at a conversion from 30 to 65 percent by volume of the feed to the FCC unit. The hydrocarbon effluent from the FCC unit can be hydrotreated to produce a low sulfur hydrocarbon effluent.

The heavy oil or bitumen production can include injecting steam through one or more injection wells completed in communication with the reservoir to mobilize the heavy oil or bitumen, and producing the mobilized heavy oil or bitumen from at least one production well completed in communication with the reservoir. The heavy oil or bitumen production can include extraction from mined tar sands. The process can further include feeding a portion of the asphaltenes fraction to a delayed coker unit to produce coker liquids and coke. The process can include feeding the coker liquids to the hydrotreating with the FCC hydrocarbon effluent. The process can also include supplying decant oil from the FCC unit to combustion, gasification or a combination thereof. The operating conditions in the FCC unit can be adjusted to control proportions of naphtha, distillate and gas oil in the hydrocarbon effluent from the FCC unit. The hydrotreating can be effected at a moderate pressure of from 3.5 to 10.5 MPa (500 to 1500 psi). The process can include gasifying asphaltenes recovered in the asphaltenes fraction from the solvent deasphalting to produce hydrogen for the hydrotreating.

In another embodiment, the application provides an apparatus for upgrading crude oil from a subterranean reservoir of heavy oil or bitumen. The apparatus can include means for converting asphaltenes to steam, power, fuel gas, or a combination thereof for use in producing heavy oil or bitumen from a reservoir. Means can be provided for solvent deasphalting at least a portion of the produced heavy oil or bitumen containing high metals to form an asphaltene fraction and a deasphalted oil (DAO) fraction essentially free of asphaltenes having a reduced metals content. Means can be provided for supplying the asphaltenes fraction from the solvent deasphalting to the asphaltenes conversion. Means can be provided for supplying a feed comprising the DAO fraction to a reaction zone of a fluid catalytic cracking (FCC) unit with FCC catalyst to deposit metals from the deasphalted oil fraction onto FCC catalyst. The apparatus can further include means for recovering a demetallized hydrocarbon effluent from the FCC unit; and means for removing metallized FCC catalyst from the FCC unit.

The apparatus can include means for injecting a mobilizing fluid through one or more injection wells completed in communication with the reservoir to mobilize the heavy oil or bitumen, and means for producing the mobilized heavy oil or bitumen from at least one production well in communication with the reservoir. The apparatus can include means for generating the mobilizing fluid comprising steam primarily by combustion of asphaltenes recovered in the asphaltenes fraction from the solvent deasphalting means. The apparatus can include means for extracting heavy oil or bitumen from mined tar sands. The solvent deasphalting means can provide a high lift. The apparatus can further include means for feeding a portion of the asphaltenes fraction to a delayed coker unit to produce coker liquids and coke. The apparatus can further include means for operating the FCC unit at a conversion from 30 to 65 percent by volume of the feed to the FCC unit. The apparatus can include means for adjusting operating conditions in the FCC unit to control proportions of naphtha, distillate and gas oil in the hydrocarbon effluent from the FCC unit. The apparatus can include means for hydrotreating the hydrocarbon effluent from the FCC unit to produce a low sulfur hydrocarbon effluent. The apparatus can include means for effecting the hydrotreating at a moderate pressure of from 3.5 to 10 MPa (500 to 1500 psi). The apparatus can also include means for gasifying asphaltenes recovered in the asphaltenes fraction from the solvent deasphalting to produce hydrogen for the hydrotreating.

In another embodiment, an apparatus for producing and upgrading crude oil from a subterranean reservoir of heavy oil or bitumen is provided. The apparatus can include means for injecting steam through one or more injection wells completed in communication with the reservoir to mobilize the heavy oil or bitumen, means for producing the mobilized heavy oil or bitumen from at least one production well completed in communication with the reservoir, means for solvent deasphalting at least a fraction of the produced heavy oil or bitumen containing high metals to form a resin-lean asphaltene fraction and a deasphalted oil (DAO) fraction essentially free of asphaltenes having a reduced metals content, means for generating steam for the injection means by combustion of asphaltenes recovered in the asphaltenes fraction from the solvent deasphalting means, means for supplying a feed comprising the DAO fraction and other lower boiling hydrocarbon fractions to a reaction zone of a fluid catalytic cracking (FCC) unit with FCC catalyst to recover a demetallized hydrocarbon effluent from the FCC unit at a conversion rate from 30 to 65 percent by volume of the DAO containing feed to the FCC unit, and means for hydrotreating the hydrocarbon effluent from the FCC unit to produce a low sulfur hydrocarbon effluent.

The apparatus can include means for feeding a portion of the asphaltenes fraction to a delayed coker unit to produce coker liquids and coke. The apparatus can include means for feeding the coker liquids to the hydrotreating means with the FCC hydrocarbon effluent. The apparatus can include means for supplying decant oil from the FCC unit to combustion, gasification or a combination thereof. The apparatus can include means for adjusting operating conditions in the FCC unit to control proportions of naphtha, distillate and gas oil in the hydrocarbon effluent from the FCC unit. The apparatus can include means for effecting the hydrotreating at a moderate pressure of from 3.5 to 10 MPa (500 to 1500 psi). The apparatus can include means for gasifying asphaltenes recovered in the asphaltenes fraction from the solvent deasphalting means to produce hydrogen for the hydrotreating means.

BRIEF DESCRIPTION OF THE DRAWINGS

For a more detailed description of the illustrated embodiments of the present invention, reference will now be made to the accompanying drawings, wherein.

DETAILED DESCRIPTION OF THE INVENTION

Detailed embodiments of the present invention are disclosed herein. However, it is understood that the disclosed embodiments are merely exemplary of the invention, which can be embodied in various forms. Specific structural, functional and process details disclosed herein are not intended to be limiting, but are merely illustrations that can be modified within the scope of the attached claims.

The present invention can convert heavy oils and/or bitumen having a high metal content to lower boiling hydrocarbons having a substantially reduced metal content. The present invention can also provide for the simultaneous production of asphaltenes for use as fuel in the generation of steam and energy necessary for the production of the heavy oil or bitumen. A first portion of the metals is removed during solvent extraction of the heavy oil or bitumen feed, with substantially all remaining metals being removed during subsequent treatment in an FCC unit. The present invention provides a substantial economic advantage by eliminating the need to transport natural gas or other fuel to the location of the reservoir for steam and or power generation. The heavy oil can be upgraded by front-end removal of the asphaltene fraction, which can frequently contain a substantial portion of undesirable sulfur, nitrogen and metal compounds. The deasphalted oil is liquid at ambient condition and can be transported using traditional methods.

Figure 1:
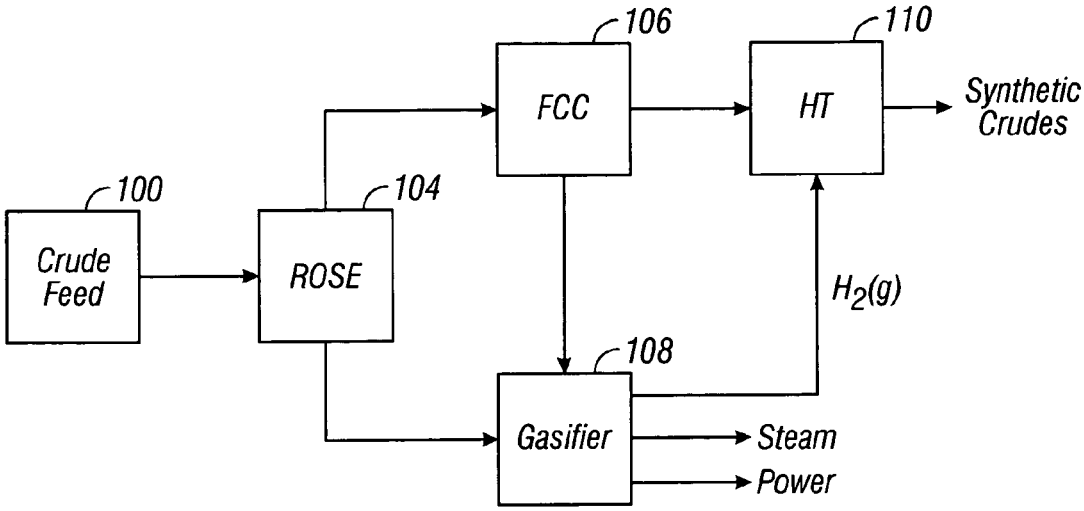
FIG. 1 shows a process according to one embodiment of the invention for the treatment of heavy oils and/or bitumens requiring no import of power, steam or hydrogen.

As shown in FIG. 1, a crude feed 100, which can include heavy oils and/or bitumens, is supplied to a residuum oil solvent extraction (ROSE) unit 104. The feed may optionally include a hydrocarbon solvent to assist in reducing the viscosity of the feed. The ROSE unit 104 separates the feed into at least two fractions: a first fraction which can include deasphalted oils and resins, and a second fraction which can include asphaltenes. A portion of the metals present in the initial feed are separated from the distillate feed and preferentially remain with the separated asphaltenes. The deasphalted oils and resins are supplied to a fluid catalytic cracking (FCC) unit 106, which can include a low activity catalyst, to upgrade the oils and effectively remove remaining metals.

The asphaltenes from the ROSE unit 104 can be converted to pelletized form using known equipment or can alternatively be supplied to a gasifier 108, which burns and/or partially oxidizes the asphaltenes to produce steam, hydrogen and low energy gas, as needed. The effluent from FCC unit 106 can be supplied to a hydrotreater unit 110 where it can be upgraded, desulfurized and separated to produce naphtha, distillate and gas oil streams. The decant oil from the FCC 106 can be supplied to the gasifier 108. The steam, hydrogen and low energy fuel gas produced by the gasifier 108 can be supplied to associated processes as needed. The product streams from the hydrotreater 110 can be combined to form a synthetic crude if desired.

Heavy oils and bitumens can be recovered through thermal processes in which heat is generated above ground or in situ. The simplest thermal process is steam injection, wherein steam is used as a driving fluid to displace oil. Steam Assisted Gravity Drainage (SAGD) is a technique wherein steam is injected directly into a formation for enhanced recovery of oils. Steam is injected through one or more wells into the top of a formation and water and hydrocarbons can be recovered from one or more wells positioned at the bottom of the formation. SAGD processes generally have a high recovery rate and a high oil rate at economic oil-to-steam ratios. Production using SAGD processes can be improved, if desired, by using techniques well known in the art, such as for example, injecting steam into the wells at a higher rate than others, applying electrical heating to the reservoir, and employing solvent CO2 as an additive to the injection steam. SAGD techniques are disclosed in U.S. Pat. No. 6,357,526 to Abdel-Halim, et al.

Heavy crudes can also be recovered by a variety of traditional mining techniques, including employing shovels, trucks, conveyors and the like, to recover substantially solid bitumens and tar sands. The shovels can be electrically or hydraulically powered. Tar sand deposits can be excavated using traditional techniques for the recovery of heavy oils contained therein. The excavated sand deposits can optionally be pre-conditioned to facilitate the extraction and separation of bitumen oils. The tar-sands can be crushed to a smaller size using conventional crushers, and can be further broken down using mechanical crushing and/or agitation. The crushed tar-sands can be readily slurried with hot water for transportation and supplied to a bitumen extraction and separation means. Conditioning of tar-sands is further disclosed in U.S. Pat. No. 4,875,998 to Rendall.

The conditioned heavy oil or bitumen, mixed with steam and/or water can be passed through a water-oil separator to separate the fluids and produce a heavy oil or bitumen stream essentially free of water and solids. The heavy oil or bitumen can be separated in a continuous fractionation process, normally taking place at atmospheric pressure and a controlled bottom temperature of less than 400° C. (750° F.). Temperature of the fractionation tower bottoms can be controlled to prevent thermal cracking of the crude feed. If desired, vacuum fractionation can be used.

The heavy oil or bitumen, or the resid from atmospheric and/or vacuum distillation, can be supplied to a solvent deasphalting unit, which can be a conventional unit, employing equipment and methodologies for solvent deasphalting which are widely available in the art, for example, under the trade designations ROSE, SOLVAHL, or the like. Desirably, a ROSE unit is employed. The solvent deasphalting unit can separate the heavy oil or bitumen into an asphaltene-rich fraction and a deasphalted oil (DAO) fraction. As is well known, the deasphalting unit can be operated and conditions varied to adjust the properties and contents of the DAO and asphaltenes fractions. Desirably, the deasphalting unit can be controlled to ensure high lift in which a majority of the resins present in the feed are separated as deasphalted oils rather than asphaltenes. The asphaltene phase can be essentially free of resins. The asphaltene phase can be heated and steam stripped to form an asphaltene product stream. The solvent-DAO phase can be heated to separate the components into solvent and DAO phases. The DAO phase can be recovered, heated and steam stripped to form a DAO product stream for further treatment.

The ROSE process can be readily modified for use herein by the skilled artisan, although where no fractionation is employed, such modifications should of course be made to accommodate the entire crude feed, and not just the resid fraction of the feed. Deasphalting can also be accomplished by dissolving the crude feedstock in an aromatic solvent, followed by the addition of an excess of an aliphatic solvent to precipitate the asphaltenes. Subcritical extraction, where hydrocarbon solvents can be mixed with alcohols, can be used. Most deasphalting processes employ light aliphatic hydrocarbons, such as for example, propane, butane, and pentane, to precipitate the asphalt components from the feed.

The DAO fraction can be supplied to an FCC unit containing a conventional cracking catalyst. The FCC unit can include a stripper section and a riser reactor. Fresh catalysts can be added to the FCC unit, typically via the regenerator. Spent catalyst, including coke and metals deposited thereon, can be regenerated by complete or partial combustion in a regenerator to supply regenerated catalyst for use in the reactor. The flue gases can be withdrawn from the top of a regeneration reactor through a flue gas line. A decant oil stream containing heavy oils and catalyst fines can be withdrawn from the FCC unit and supplied as a fuel oil and/or to a gasifier and/or coker. Exemplary FCC processes are disclosed in U.S. Pat. No. 4,814,067 to Gartside, et al.; U.S. Pat. No. 4,404,095 to Haddad, et al.; U.S. Pat. No. 3,785,782 to Cartmell; U.S. Pat. No. 4,419,221 to Castagnos, Jr.; U.S. Pat. No. 4,828,679 to Cormier, Jr., et al.; U.S. Pat. No. 3,647,682 to Rabo, et al.; U.S. Pat. No. 3,758,403 to Rosinski, et al.; and U.S. Pat. No. RE 33,728 to Dean, et al.

The catalyst inventory employed in the FCC unit of the present invention desirably provides equilibrium catalyst microactivity test conversions between 35 and 60% per volume feed. Higher conversion does not generally provide any benefit in some embodiments of the present invention and can have the disadvantage of higher catalyst replacement rates. By maintaining lower catalyst activity, catalyst consumption can be optimized for more economic usage of the catalyst.

In catalytic cracking, catalyst particles are heated and introduced into a fluidized cracking zone with a hydrocarbon feed. The cracking zone temperature is typically maintained between 480° and 565° C. (900° and 1050° F.) at a pressure between about 0.17 and 0.38 MPa (25 and 55 psia). The circulation rate of the catalyst in the reactor can range from about 1.8 to 4.5 kg/kg of hydrocarbon feed (4 to 10 lb/lb of hydrocarbon feed). Any of the known catalysts useful in fluidized catalytic cracking can be employed in the practice of the present invention, including but not limited to Y-type zeolites, USY, REY, RE-USY, faujasite and other synthetic and naturally occurring zeolites and mixtures thereof. Other suitable cracking catalysts include, but are not limited to, those containing silica and/or alumina, including acidic catalysts. The catalyst can contain refractory metal oxides such as magnesia or zirconia. The catalyst can contain crystalline aluminosilicates, zeolites, or molecular sieves. Discarded or used catalyst from a high activity FCC process can be conveniently and inexpensively employed in the place of fresh catalyst.

The FCC unit can produce some lighter gases such as fuel gas, liquefied petroleum gas (LPG), or the like, which can be used as a fuel. These may contain sulfur compounds which can be removed, if desired, using a small conventional sulfur removal unit with amine absorption, or the like.

The asphaltene fraction from the ROSE unit can be supplied to a pelletizer and pelletized, as is known by those skilled in the art. A suitable pelletizer is described in U.S. Pat. No. 6,357,526 to Abel-Halim, et al. The asphaltene pellets can be transported in a dewatered form by truck, conveyor, or other means, to a boiler or gasifier, or can be slurried with water and transferred via pipeline. A portion of the asphaltenes can be passed or transported to a solids fuel mixing facility, such as a tank, bin or furnace, for storage or use as a solid fuel. The boiler can be any conventionally designed boiler according to any suitable type known to those skilled in the art, but is desirably a circulating fluid bed boiler, which burns the pellets to generate steam for use in the SAGD process for the production of the heavy oil or bitumen. Alternatively, the boiler can provide electric power, or steam for the excavation and extraction equipment in a tar sand mining operation, including shovels, trucks, conveyors, hot water and so forth, as needed. The quantity of asphaltenes produced can be large enough to satisfy all of the steam and power requirements in the production of the heavy oil or bitumen, thus eliminating the need for imported fuel or steam, resulting in a significant reduction in the cost of production.

A gasifier can alternatively or additionally be employed, with the asphaltene fraction being conveniently pelletized and slurried to supply the water for temperature moderation in the gasification reactor. If desired, excess asphaltene pellets not required for the boiler(s) and/or gasification can be shipped to a remote location for combustion or other use.

Steam can be generated by heat exchange with the gasification reaction products, and CO2 can also be recovered in a manner well known to those in the art for injection into the reservoir with steam for enhanced production of heavy oils and bitumen. Hydrogen gas, and/or a low value fuel gas, can be recovered from the gasification effluent and exported, or the hydrogen can be supplied to an associated hydrotreating unit, as described below. Power can also be generated by expansion of the gasification reaction products and/or steam via a turbine generator. The power, steam and/or fuel gas can be used in the heavy oil or bitumen production, e.g. mining operations or SAGD, as described above. During startup, it may be desirable to import asphalt pellets, natural gas, or other fuel to fire the boiler to supply sufficient steam and/or energy for the production of heavy oil or bitumen until the recovered asphaltene fraction is sufficient to meet the requirements for steam generation.

Alternatively or additionally, at least a portion of the asphaltene fraction and/or slurry oil can be supplied to a coker unit for maximizing distillates recovery. Coking processes are well known for converting very heavy low value residuum feeds from vacuum or atmospheric distillation columns to obtain coke and gas oil. Typically, the asphaltene fraction is heated to high temperatures in a coker unit, e.g. 480-510° C. (900-950° F.) to generate lighter components which are recovered as a vapor, and coke which forms as a solid residue in the coking unit. The coker unit can be a delayed coker, a flexicoker, a fluid coker, or the like as desired, all of which are well known in the art. In a delayed coking process, the feed is held at a temperature of approximately 450° C. and a pressure from 75 to 170 kPag (10 to 25 psig) to deposit solid coke while cracked vapors are taken overhead. Coke produced in the coker can be transported to a storage area for use as a solid fuel.

Product vapors from the coker can be withdrawn from the coker and supplied to an associated process, desirably a hydrotreating process. Optionally, the coker vapors can be separated by distillation into naphtha, distillate and gas oil fractions prior to being supplied to the hydrotreatment unit. By limiting the feed to the coker in the present process to the excess asphaltenes fraction and FCC slurry oil that is not needed for generating steam, hydrogen and power, the size of the coker can be advantageously reduced relative to front-end coker processing schemes.

Hydrotreatment of the FCC effluent (and any coker liquids) can improve the quality of the various products and/or crack residuum oils to lower-boiling, more valuable products. Mild hydrotreating can remove unwanted sulfur, nitrogen, oxygen, and metals, as well as hydrogenate any olefins. However, removal of sulfur and metals via a front-end hydrotreating process before FCC processing requires relatively large amounts of hydrogen, often requiring a separate hydrogen production unit or other source.

The hydrotreater in the present invention operates downstream from the FCC unit to treat the hydrocarbon feed after the metals have been removed, and primarily serves to remove sulfur from the feed. The hydrotreater can operate at between 0.8 and 21 MPa (100-3000 psig) and 350° and 500° C. (650° and 930° F.). Mild operating conditions for the hydrotreater can include a fixed bed operating at between 1.5 and 2.2 MPa (200-300 psig) and 350° to 400° C. (650° to 750° F.), without catalyst regeneration. Severe operating conditions for the hydrotreater are from 7 to 21 MPa (1000 to 3000 psig) and 350° to 500° C. (650° to 930° F.), and requiring catalyst regeneration. Desirably, the pressure is maintained in a moderate range between 3.5 and 10.5 MPa (500 to 1500 psi). Hydrogen consumption increases with increased severity of operating conditions and also depends upon the amount of metal and sulfur removed and the feed content of aromatic materials and olefins, which also consume hydrogen. Because the metal content of the feed to the hydrotreater is negligible, a guard bed is not needed and high activity catalyst can be employed. Gas and LPG products from the hydrotreater will contain sulfur compounds, which can be removed in a conventional sulfur recovery unit as described above. The sulfur recovery unit processing the hydrotreater light ends can be the same unit as for the FCC effluent, sized appropriately to accommodate both feeds, or separate sulfur recovery units can be employed.

By placing the solvent deasphalting and FCC units upstream of the hydrotreater, and removing metals prior to hydrotreating, the present invention decreases the dependence of the process on the production of large quantities of hydrogen, and decreases the need for separate hydrogen production facilities.

One advantage to the present invention is that individual aspects of the present invention can be added to existing bitumen processing facilities, or that said facilities can be constructed in a stepwise manner incorporating any number of the aspects of the present invention, as desired. Referring to FIGS. 2-5, wherein like numerals are used in reference to like parts, the stepwise construction of a heavy oil and/or bitumen recovery process is shown.

Figure 2:
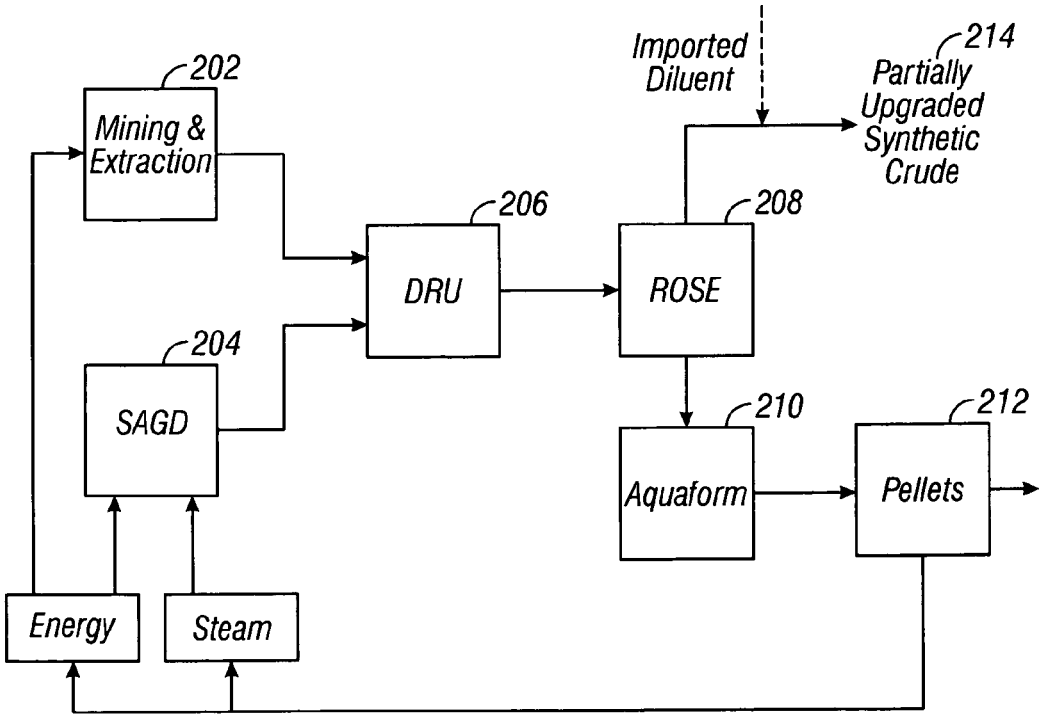
FIG. 2 shows a process according to one embodiment of the invention for the partial upgrading of heavy oil or bitumen feedstock.

Referring initially to FIG. 2, the base case upgrade in the stepwise construction is shown. A heavy oil and/or bitumen feed is obtained by excavation 202 and/or steam assisted gravity drainage 204. Solvent can be added to the feed as necessary (not shown) to facilitate transfer of the heavy oil/bitumen feed to the diluent recovery unit (DRU) 206 wherein the crude undergoes atmospheric distillation. The residue from the distillation column can be supplied to an on-site or nearby ROSE unit 208 for separation of the DAO and resins from the asphaltenes. The asphaltene fraction can be removed from the ROSE unit and supplied to an aquaform unit 210 for the preparation of asphaltene pellets 212. The asphaltene pellets 212 can be used as fuel, exported or stored. The DAO/resin fraction can be added to an imported diluent and collected as partially upgraded synthetic crude 214.

Figure 3:
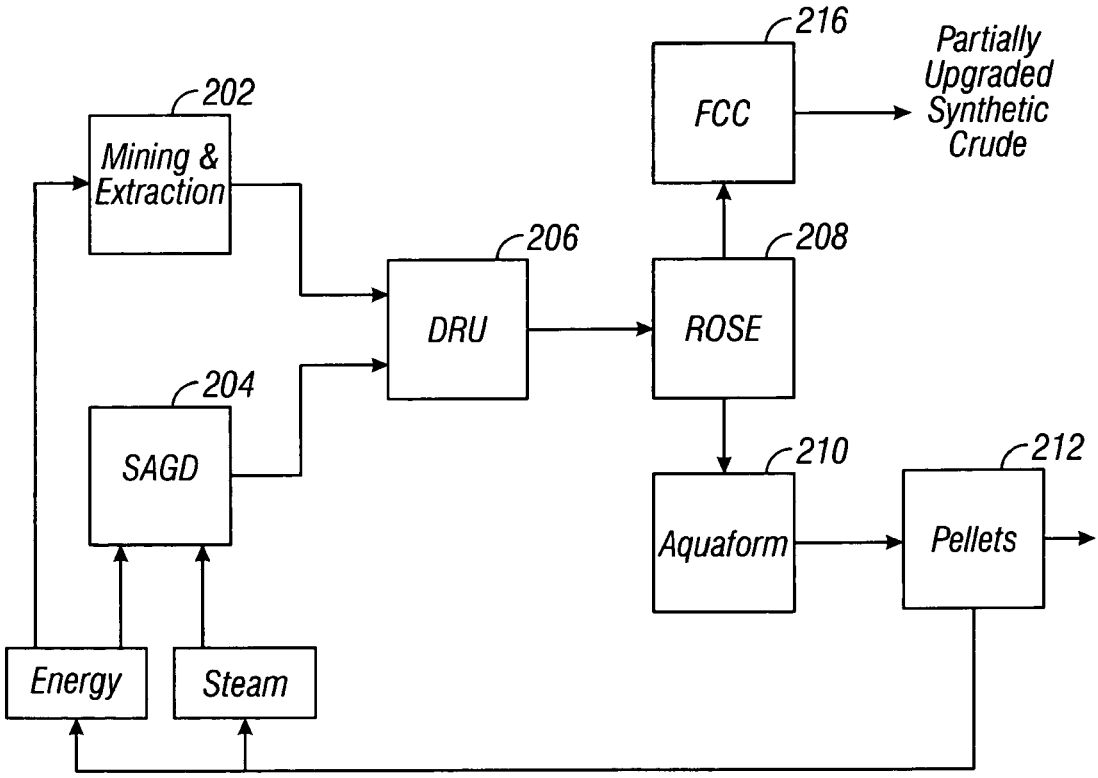
FIG. 3 shows the process of FIG. 2 wherein an FCC unit has been added.

Referring to FIG. 3, an FCC unit 216 has been added to the FIG. 2 process. The FCC unit 216 is desirably at the same location or in close proximity to the ROSE unit 208. The DAO/resin fraction can be supplied to an FCC unit 216 having a low activity catalyst as previously described herein. The FCC unit 216 removes substantially all remaining metals in the feed not previously removed by the ROSE unit 208.

Figure 4:
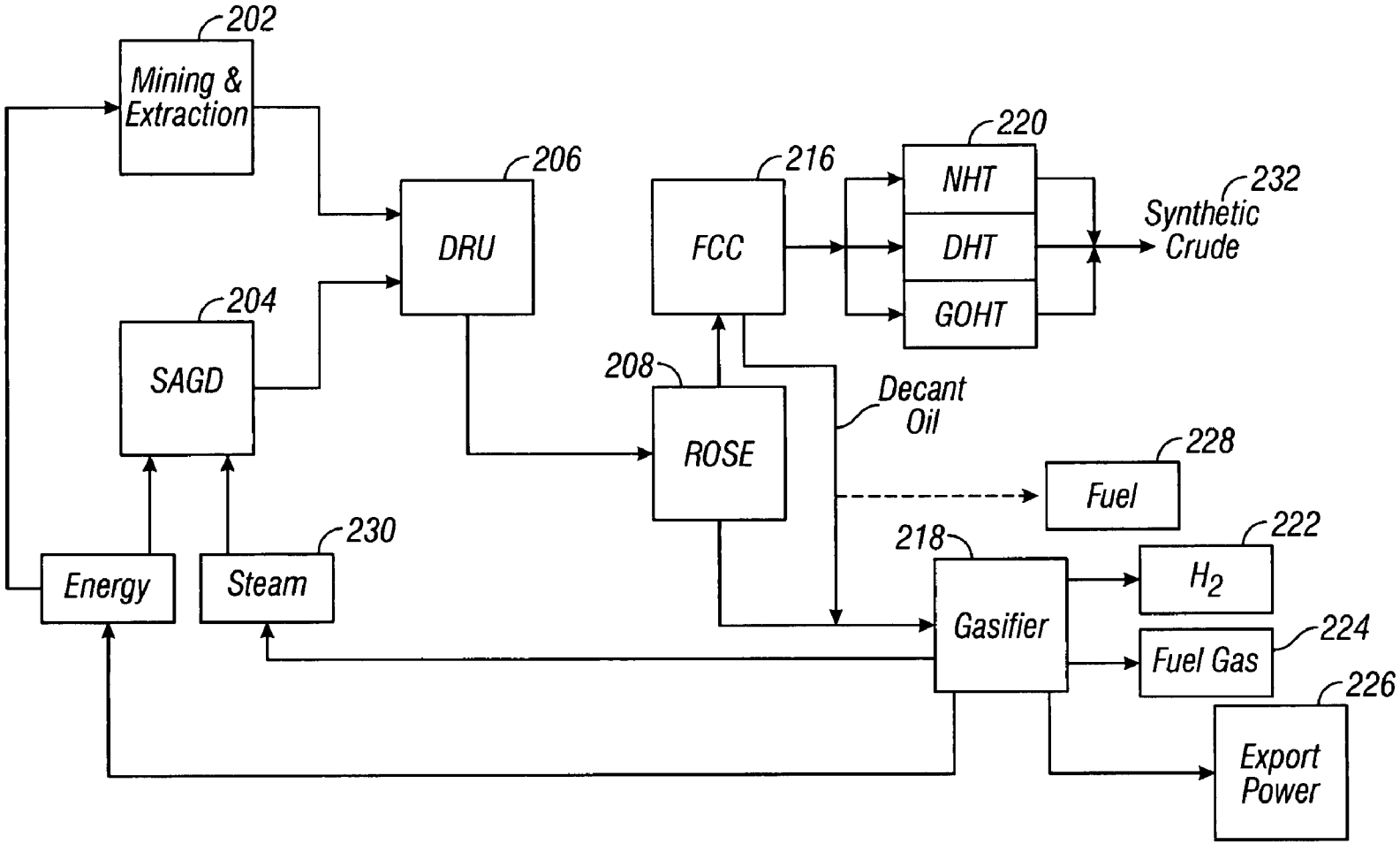
FIG. 4 shows the process of FIG. 2 including a gasifier and a hydrotreating unit.
Figure 5:
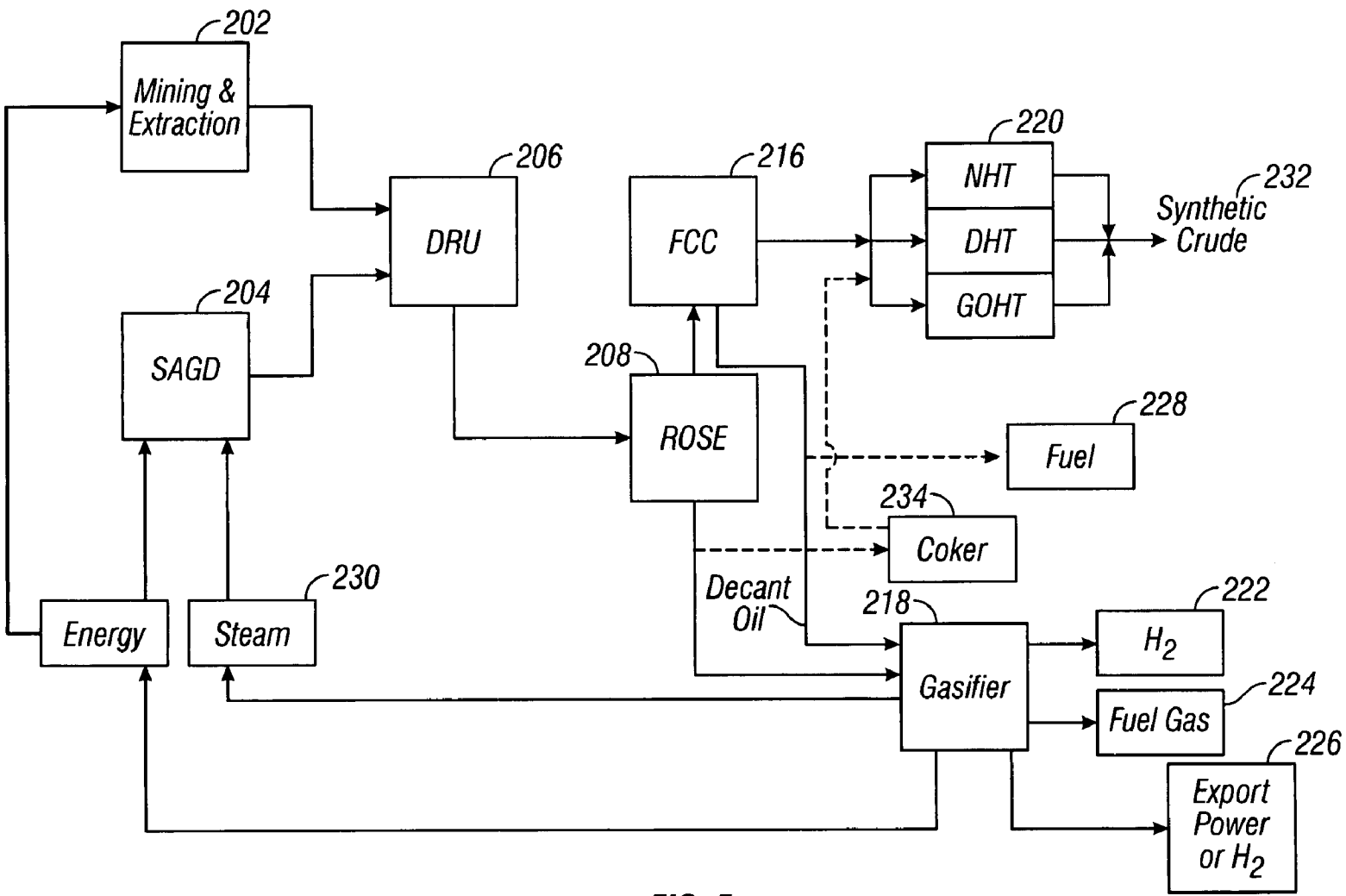
FIG. 5 shows the process of FIG. 4 with an added coker unit.

Referring to FIG. 4, the FIG. 2 process includes a gasifier 218, and a hydrotreater 220 has been added downstream of the FCC unit 216. The asphaltene fraction from the ROSE unit 208 can be supplied to the gasifier 218 which partially oxidizes the asphaltene to produce hydrogen 222, fuel gas 224, power 226, which can either be exported or supplied to the SAGD unit 204, and steam 230, which can be supplied to the SAGD unit 204. A decant oil stream recovered from the FCC unit 216 can be supplied to the gasifier 218, or used as fuel 228. An essentially metal free stream of partially upgraded synthetic crude can be supplied from the FCC unit 216 to the hydrotreater 220, which can optionally include separating the naphtha, distillate, and gas oil prior to hydrotreating. The hydrotreated naphtha, distillate, and gas oil can be blended to produce a synthetic crude 232. The gasifier 218 and hydrotreater 220 are desirably located in the same plant, and especially in close proximity to the FCC unit 216 and/or ROSE unit 208, or on-site with the heavy oil or bitumen production Referring to FIG. 5, a coker unit 234 has been added to the process of FIG. 4 for improved recovery. A portion of the asphaltene fraction from the ROSE unit 208 can be supplied to coker unit 234. The coker unit 234 can produce a cracked effluent which can include naphthas, distillates and gas oils, and can be combined with the FCC unit 216 effluent and supplied to the hydrotreater 220 for further upgrading to a metal free synthetic crude 232. The coker unit is desirably located on-site or in close proximity to the ROSE unit 208 and/or FCC unit 216.

Another advantage to the present invention is an energy cost of near zero once the facilities are installed and operational. Because the asphaltene product can be readily converted to transportable, combustible fuel, the need for imported hydrogen, fuel and/or energy can be eliminated. The current process can thus be self-sufficient with respect to power, hydrogen and steam requirements for the SAGD and hydrotreater processes in the recovery and upgrade of heavy oils and/or bitumens. Similarly, power can be provided to mining equipment reducing requirements as compared to traditional mining processes. The capital costs associated with the present invention are slightly higher than those associated with other methods for the recovery of bitumens, such as for example, processes employing front end delayed coking or ebullated bed hydrocracking. However, the present invention has a better return on investment, lower complexity and simpler operation, less coke disposal, complete energy self sufficiency, and can be constructed or be added as an upgrade in a stepwise fashion.

Example. Referring to the process shown in FIG. 5, feed comprising 28,900 m3/d (182,000 BPD (42-gallon barrels per day)) of 10-15 API diluted bitumen and heavy oils is supplied to a diluent recovery unit (DRU) 308. The DRU 308 supplies 24,800 m3/d (156,000 BPD) feed to the ROSE unit 314, where the unit 314 separates the feed into a DAO fraction and an asphaltene fraction. A 3,400 m3/d (21,500 BPD) stream of the asphaltene fraction is supplied to the gasifier 338, and a 3,400 m3/d (21,500 BPD) stream is supplied to the coker unit 354. An 18,000 m3/d (113,000 BPD) resid oil stream is supplied from the ROSE unit 314 to the fluid catalytic cracking (FCC) unit 328. FCC unit 328 removes remaining metals and separates the feed into a light fraction of reduced metal content and a heavy decant oil. A 3,800 m3/d (23,700 BPD) stream of the decant oil is supplied from the FCC unit 328 to the gasifier 338. A 12,600 m3/d (80,000 BPD) stream of a light fraction consisting primarily of distillates, naphtha and gas oil is supplied from the FCC unit 328 to the hydrotreater 332 where it is combined with a 2,100 m3/d (13,000 BPD) stream of gas oil collected from the coker 354 and supplied to the hydrotreater 332. Hydrotreater 332 produces 37-41 API synthetic crude at a rate of 16,000 m3/d (100,000 BPD).

Numerous embodiments and alternatives thereof have been disclosed. While the above disclosure includes the best mode belief in carrying out the invention as contemplated by the inventors, not all possible alternatives have been disclosed. For that reason, the scope and limitation of the present invention is not to be restricted to the above disclosure, but is instead to be defined and construed by the appended claims.

What is claimed is:

1. A process for upgrading crude oil from a subterranean reservoir of heavy oil or bitumen, comprising:

converting asphaltenes to steam, power, fuel gas, or a combination thereof for use in producing heavy oil or bitumen from a reservoir;

solvent deasphalting at least a portion of the heavy oil or bitumen to form an asphaltene fraction and a deasphalted oil (DAO) fraction essentially free of asphaltenes having a reduced metals content;

supplying the asphaltenes fraction from the solvent deasphalting to the asphaltenes conversion;

supplying a feed comprising the DAO fraction to a reaction zone of a fluid catalytic cracking (FCC) unit with FCC catalyst to deposit a portion of the metals from the DAO fraction onto the FCC catalyst, wherein lower boiling hydrocarbon fractions are introduced to the FCC unit with the DAO fraction;

recovering a hydrocarbon effluent having a reduced metal content from the FCC unit; and removing metallized FCC catalyst from the FCC unit.

2. The process of claim 1, further comprising producing heavy oil or bitumen by extraction from mined tar sands.

3. The process of claim 1 further comprising producing heavy oil or bitumen by injecting a mobilizing fluid through one or more injection wells completed in communication with the reservoir to mobilize the heavy oil or bitumen and producing the mobilized heavy oil or bitumen from at least one production well completed in communication with the reservoir.

4. The process of claim 3 wherein the mobilizing fluid comprises steam generated primarily by combustion of asphaltenes recovered from the asphaltenes fraction from the solvent deasphalting.

5. The process of claim 2, wherein the asphaltenes conversion comprises gasification of a portion of the asphaltenes fraction to provide power, steam, fuel gas or combinations thereof for the mining and extraction.

6. The process of claim 1 wherein the solvent deasphalting has a high lift.

7. The process of claim 1 further comprising feeding a portion of the asphaltenes fraction to a delayed coker unit to produce coker liquids and coke.

8. The process of claim 1 wherein the FCC unit is operated at a conversion from 30 to 65 percent by volume of the feed to the FCC unit.

9. The process of claim 1 wherein operating conditions in the FCC unit are adjusted to control proportions of naphtha, distillate and gas oil in the hydrocarbon effluent from the FCC unit.

10. The process of claim 1 further comprising hydrotreating the hydrocarbon effluent from the FCC unit to produce a low sulfur hydrocarbon effluent.

11. The process of claim 10 wherein the hydrotreating is effected at a moderate pressure of from 3.5 to 10 MPa.

12. The process of claim 10 further comprising gasifying asphaltenes recovered in the asphaltenes fraction from the solvent deasphalting to produce hydrogen for the hydrotreating.

* * * * *